United States Patent [19]

Kuechler

[11] 4,250,870

[45] Feb. 17, 1981

[54] APPARATUS AND METHOD FOR REMOVING FUMES FROM THE SPACE ABOVE A COOKING APPLIANCE IN A RESTAURANT

[76] Inventor: Irvin R. Kuechler, 172 E. 27th St., San Bernardino, Calif. 92404

[21] Appl. No.: 8,926

[22] Filed: Feb. 2, 1979

Related U.S. Application Data

[63] Continuation of Ser. No. 842,620, Oct. 17, 1977, abandoned, which is a continuation of Ser. No. 646,145, Jan. 2, 1976, abandoned, which is a continuation-in-part of Ser. No. 509,555, Sep. 26, 1974, Pat. No. 3,952,640.

[51] Int. Cl.[3] ..... F23J 11/00

[52] U.S. Cl. ..... 126/299 D; 55/DIG. 36

[58] Field of Search ..... 126/299 D; 55/467, DIG. 36

[56] References Cited

U.S. PATENT DOCUMENTS

| | | | |
|---|---|---|---|
| 1,014,321 | 1/1912 | Minor | 55/467 |
| 2,000,971 | 5/1935 | Manross | 55/413 |
| 2,056,022 | 9/1936 | Steenstrup | 138/42 |
| 2,607,437 | 8/1952 | Crawford et al. | 55/418 |
| 2,702,505 | 2/1955 | Nelson | 55/DIG. 36 |
| 2,748,688 | 6/1956 | Smith | 55/461 |
| 2,813,477 | 11/1957 | Gaylord | 126/299 D |
| 2,935,925 | 5/1960 | D'ooge | 98/36 |
| 3,252,400 | 5/1966 | Madl, Jr. | 98/33 R |
| 3,292,525 | 12/1966 | Jensen | 55/DIG. 29 |
| 3,366,013 | 1/1968 | Madl, Jr. | 55/DIG. 29 |
| 3,367,257 | 2/1968 | Raider et al. | 98/33 R |
| 3,410,195 | 11/1968 | King | 126/299 D |
| 3,457,850 | 8/1969 | Sweet et al. | 55/DIG. 36 |
| 3,513,766 | 5/1970 | Ahlrich | 126/299 D |
| 3,566,585 | 3/1971 | Voloshen et al. | 55/435 |
| 3,664,255 | 5/1972 | Kuechler | 126/299 D |
| 3,698,832 | 10/1972 | Price | 138/46 |
| 3,752,056 | 8/1973 | Chamberlin et al. | 98/115 LH |
| 3,854,388 | 12/1974 | King | 55/DIG. 36 |
| 3,865,022 | 2/1975 | Ahlrich | 98/115 K |
| 3,952,640 | 4/1976 | Kuechler | 126/299 D |

FOREIGN PATENT DOCUMENTS

| | | | |
|---|---|---|---|
| 313993 | 6/1929 | United Kingdom | 55/410 |

*Primary Examiner*—Ronald C. Capossela

*Attorney, Agent, or Firm*—Gausewitz, Carr, Rothenberg & Edwards

[57] ABSTRACT

An apparatus and method are disclosed whereby both the inlet and exhaust plenums may be very "wide" (long), yet low in profile, economical to construct, and have very small tendencies to collect or be plugged with grease, while still achieving the important requisite of substantially uniform flow across the entire "width" (length) of the apparatus. One set of baffle or constrictor means is provided in the inlet plenum at regions between the inlet duct and the "sides" (ends) of such plenum. Another baffle or constrictor means is provided in the extended exhaust plenum, at regions between the exhaust duct and the central region of the grease-filter means. The respective baffle or constrictor means are relatively adjacent the ducts. The baffle or constrictor means are preferably fixed or adjustable baffles, or indentations (dimples) in the walls of the plenums. In one embodiment, an air-blocking plate is provided at the air-inlet throat on each "side" of the apparatus.

In accordance with additional embodiments, blower means are incorporated in at least one of the plenums, thus resulting in substantial economies, increased compactness, ease of installation, etc.

9 Claims, 11 Drawing Figures

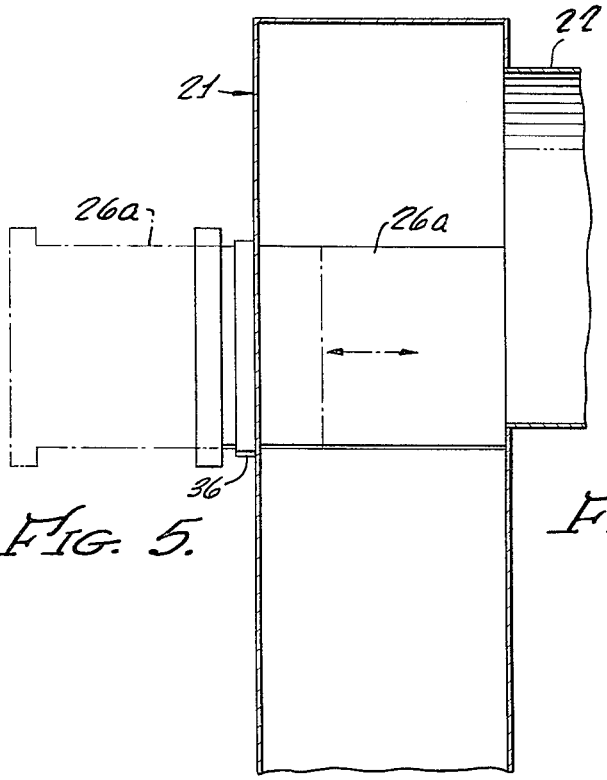
FIG. 5.
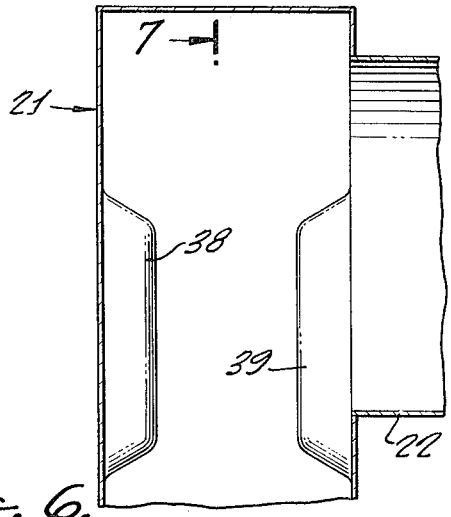
FIG. 6.
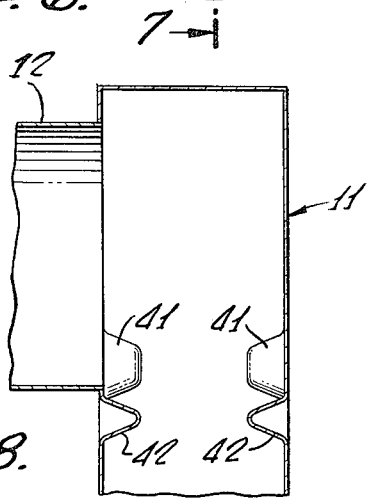
FIG. 7.
FIG. 8.
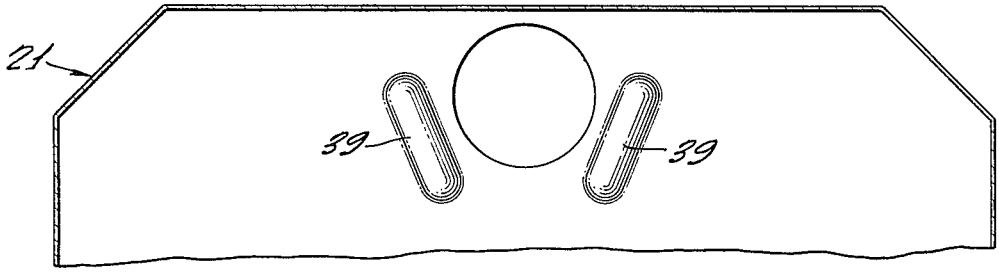
FIG. 9.
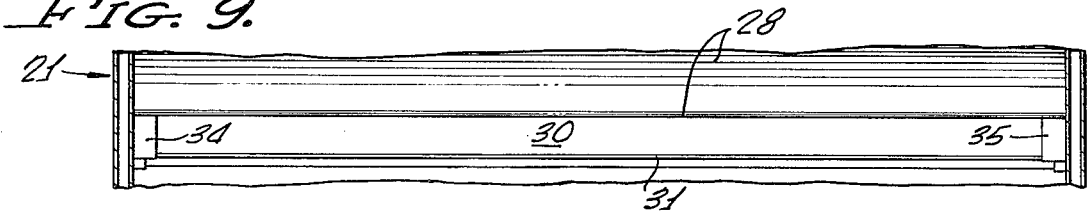

APPARATUS AND METHOD FOR REMOVING FUMES FROM THE SPACE ABOVE A COOKING APPLIANCE IN A RESTAURANT

REFERENCES TO RELATED APPLICATIONS:

This application is a continuation of my copending application Ser. No. 842,620, filed Oct. 17, 1977, for Apparatus and Method for Removing Fumes from the Space above a Cooking Appliance in a Restaurant, now abandoned, said application Ser. No. 842,620 being a continuation of application Ser. No. 646,145 filed Jan. 2, 1976, for Apparatus and Method for Removing Fumes from the Space above a Cooking Appliance in a Restaurant, now abandoned, said application Ser. No. 646,145 being, in turn, a continuation-in-part of patent application Ser. No. 509,555, filed Sept. 26, 1974, for Apparatus and Method for Extracting Grease and Smoke, and Method of Installing the Same, now Pat. No. 3,952,640.

BACKGROUND OF THE INVENTION

1. Field of the Invention

This invention is in the field of apparatus and methods for removing cooking fumes from restaurants, and particularly relates to such apparatus which does not deplete the restaurant of undesirable amounts of air.

2. Description of Prior Art

It is of extreme importance in modern-type exhaust hoods and canopies that the velocity (feet per minute) of flow of air and fumes through the grease-filter means be substantially uniform across the entire "width" (length) of the apparatus. One major reason for this is that there is a particular range of velocities which achieves optimum filtration of grease by combination centrifugal and impingement grease filters such as (for example) are described in the cited U.S. Pat. No. 3,566,585.

To achieve such substantially uniform flow velocity through the grease filters, across the width of the apparatus, the velocity of the supply air delivered to the grease filters should be substantially uniform across the width of the apparatus, and the velocity of air and fumes drawn through the filters (from the exhaust side) should be substantially uniform across the width of the apparatus. It is emphasized that the supply and exhaust velocities are not independent of each other, since the supply velocity is one major factor which regulates exhaust velocity. (It might be thought that supply velocity is automatically equal to exhaust velocity but this is not necessarily so for various reasons, one of which is that much supply air deflects off the grease filters).

The achievement of such uniform velocities should be effected with few parts, at minimum cost, and with a minimum of surfaces which may collect grease on the exhaust side of the apparatus. Also, in many installations, it should be accomplished with "low profile" equipment, by which it is meant that plenums and/or ducts should not project up an unsightly distance above the roof or ceiling of the building.

The problem of achieving uniform velocity is greatly exacerbated when the apparatus is very "wide" (long), such as fifteen, twenty or more feet. To achieve relatively uniform velocities despite such widths, with only one supply duct and one exhaust duct, and with a minimum of parts, height, and grease-collecting regions, constitutes a major advance in the art.

Reference is made to my prior U.S. Pat. No. 3,664,255, which shows in FIG. 3 a series of deflectors 39 intended to achieve uniformity of supply or inlet flow. The present invention achieves substantial uniformity without such deflectors 39, even in apparatus much "wider" (longer) than that specifically shown in the U.S. Pat. No. 3,664,255.

The exhaust apparatus shown in FIG. 4 of the U.S. Pat. No. 3,664,255 does not achieve substantially uniform exhaust velocities in "wide" (long) hoods, for example of the sizes above noted. This major problem was solved, relative to the exhaust side of the apparatus, by the "extended plenum" apparatus described at length in the cited parent patent application Ser. No. 509,555. However, a problem remained relative to excessive height on some very wide installations, which problem generated the solution shown in FIG. 8 of such parent patent application (FIG. 2 of the present application). Such construction of FIG. 8 is intended to replace the vastly more expensive double systems previously used (more than one year prior to the filing date of the present application), and shown (for example) by FIG. 6 of such parent application. FIG. 8 of said parent application is clearly not prior art relative to the present application, in that the construction shown thereby has not yet been marketed, etc.

Reference is also made to the following two approaches (both of which were employed in the prior art): (a) adjusting the filters differently (for greater or lesser flow) at different points across the width of the apparatus, and (b) placing screens or baffles or the like in the plenum adjacent the filters or in connecting ducts. Approach (a) (which has been employed by prior-art workers in conjunction with the filters of the above-cited U.S. Pat. No. 3,566,585) is unsatisfactory in that the adjustment impairs filtration in certain regions, and in that the filters may be incorrectly rearranged after cleaning. Approach (b) (also in the prior art) is unsatisfactory for reasons including the fact that the screens plug up with grease, and baffles (unless employed in an extended plenum as described in the present application) collect grease excessively and/or do not do the job satisfactorily. Reference is made to the above-cited U.S. Pat. No. 3,664,255 at column 5, lines 24 et seq. wherein baffles are mentioned.

SUMMARY OF THE INVENTION

According to the present apparatus and method, substantially uniform supply and exhaust velocities are achieved even in very "wide" (long) apparatus, in a economical and substantially non grease-collecting manner, and with relatively low profile. These and other highly desired results are achieved by using extended exhaust and inlet plenum chambers which are constricted or baffled at certain critical regions which are vastly different from each other on the inlet and exhaust sides.

The constriction or baffle means in the inlet or supply plenum are provided between the supply duct and the "sides" (ends) of the apparatus. Conversely, the baffle or constriction means in the extended exhaust plenum are provided between the exhaust duct and the central region of the filter means. In the extended exhaust plenum, the baffle or constriction means are spaced away from the grease filters and are relatively adjacent the exhaust duct. In both inlet and exhaust plenums, the duct diameter is preferably much greater than plenum "depth" (thickness).

The constriction or baffle means are, in accordance with one embodiment, adjustable to different settings. In another embodiment the constriction or baffle means are economical and non grease-catching dimples or indentations.

In one embodiment, constriction or baffle means are provided in the inlet or supply throat at the "sides" (ends) of the apparatus.

In accordance with further embodiments, the blower means are incorporated in at least one of the plenums, thus achieving important advantages relative to economy of production, ease of installation, reduced size of the overall apparatus, etc.

BRIEF DESCRIPTION OF THE DRAWINGS:

FIG. 5 is a fragmentary vertical sectional view corresponding to the upper-right region of FIG. 4, but illustrating an embodiment wherein the baffles in the inlet plenum are adjustable;

FIG. 6 also corresponds to the upper-right portion of FIG. 4, but shows an embodiment wherein dimples or indentations are employed as the baffles or constrictions;

FIG. 7 is a sectional view on line 7—7 of FIG. 6, showing such dimples, the relationship being the same as shown in FIG. 3 except that the constriction or baffling is effected by elongated dimples;

FIG. 8 is a fragmentary sectional view of a region corresponding to the upper-left part of FIG. 4, except that an embodiment is shown wherein the constriction or baffling is effected by dimples or indentations;

FIG. 9 is a view looking from station 9—9 shown in FIG. 4, and showing an embodiment wherein constriction or baffling plates are provided at the "sides" (ends) of the inlet or supply throat;

DETAILED DESCRIPTION OF THE PREFERRED EMBODIMENT

Figure 1:
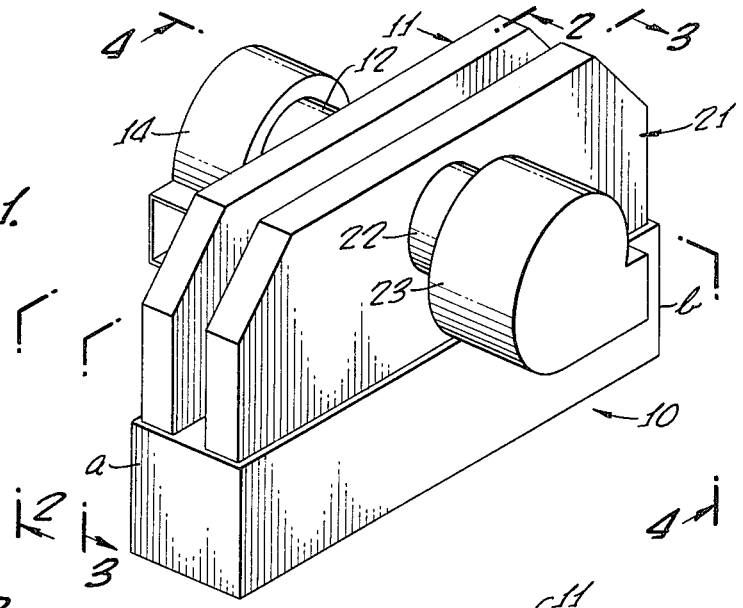
FIG. 1 is an isometric view which shows schematically a smoke hood constructed in accordance with the present invention.
Figure 2:
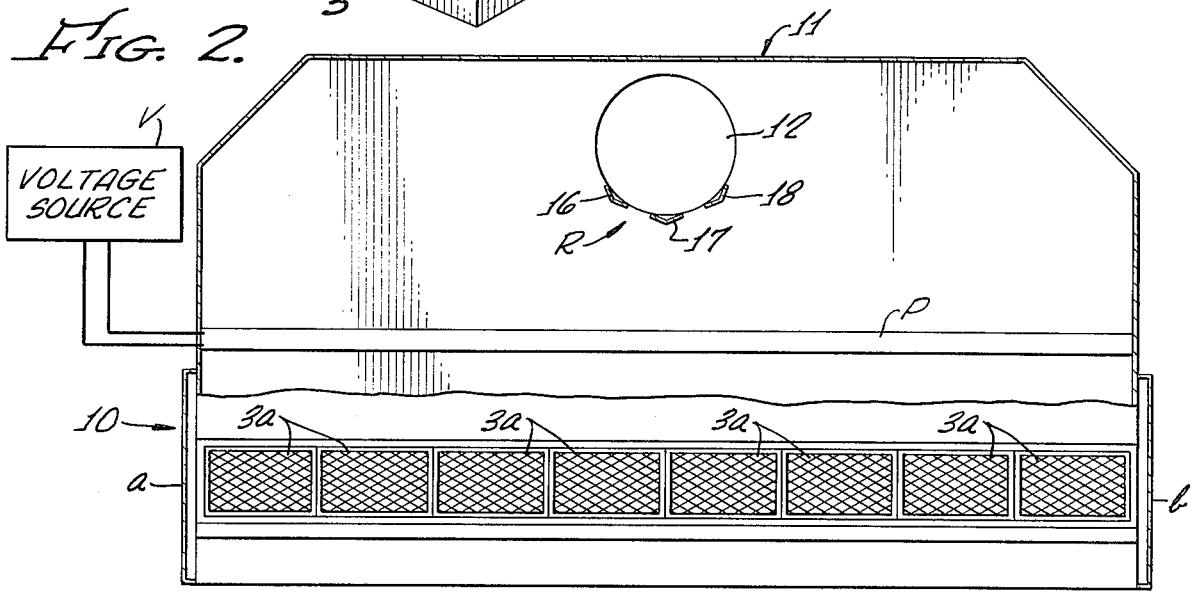
FIG. 2 is a vertical sectional view on line 2—2 of FIG. 1, showing the exhaust filters and extended plenum, and the baffles or constrictors (and duct) associated therewith.

Throughout this specification, the word "width" is normally employed instead of "length", and (correspondingly) the word "sides" is used in lieu of "ends." Thus, for example, and referring to FIGS. 1 and 2, the distance from surface "a" to surface "b" is the approximate "width" of the hood, not its length. Surfaces "a" and "b" are the "sides" of the hood, not the ends. This convention is employed to accord with certain previous patent applications, because some aspects of the invention relate to hoods of widely-varying sizes and proportions, and because the cooks and other viewers usually face the filter means as shown in FIG. 2 and, therefore, think in terms of width and not length. Following the same convention, the inlet and exhaust plenums, their openings, etc., may be stated to be "wide" or large-dimensioned in a direction from one side of the hood to the other side thereof.

EMBODIMENT OF FIGS. 1-4

Referring to FIG. 1, there is shown an extremely large smoke or grease hood 10 of the type described in the above-cited U.S. Pat. No. 3,664,255, as modified in accordance with the above-cited application Ser. No. 497,690. Such apparatus may be, for example, about 15 or 20 feet "wide" (distance from left to right, between surfaces a and b, FIG. 2). Connected to hood 10, and extending upwardly therefrom, is an exhaust plenum extension 11. Such extension 11 is much less tall, considering the great width of the apparatus, than would be expected. For example, and although the apparatus is (for example) about 15 or 20 feet wide, the plenum extension 11 need only extend about 6 or 7 feet (or less) above the ceiling or roof when the apparatus is fully installed.

The exhaust plenum extension 11 need not be tall, despite the great width of the apparatus, because there is provided a means R (FIGS. 2 and 4) to restrict, baffle or deflect flow to the exhaust duct 12 from the central regions of the exhaust chamber 13 (FIG. 4), that is to say from the central region of the below-described horizontal row of grease filters 3*a*. Means R reduces the flow velocity of air and fumes through the central (least remote from the exhaust duct) ones of the grease filters. The "central region" of the row of grease filters is the region substantially directly below the centrally located exhaust duct 12 (FIG. 2) connecting to exhaust blower 14 (FIG. 1).

Since the means R is provided relatively adjacent the duct 12 and preferably at the connection to such duct, it can be small and self-draining so that only a minimal maintenance problem (if any) is presented. The means R is spaced far away from the filters 3*a*.

Another reason why the exhaust plenum extension need not be tall, despite the great "width" of the apparatus, is that the diameter of duct 12 is large in comparison to the thickness or depth of the plenum extension 11. Such thickness or depth is the left-to-right distance as viewed in the upper-left part of FIG. 4. Because of this relationship, air and fumes drawn into duct 12 must enter it from all regions of plenum extension 11, not merely from (for example) the plenum extension regions directly beneath the duct.

Figure 4:
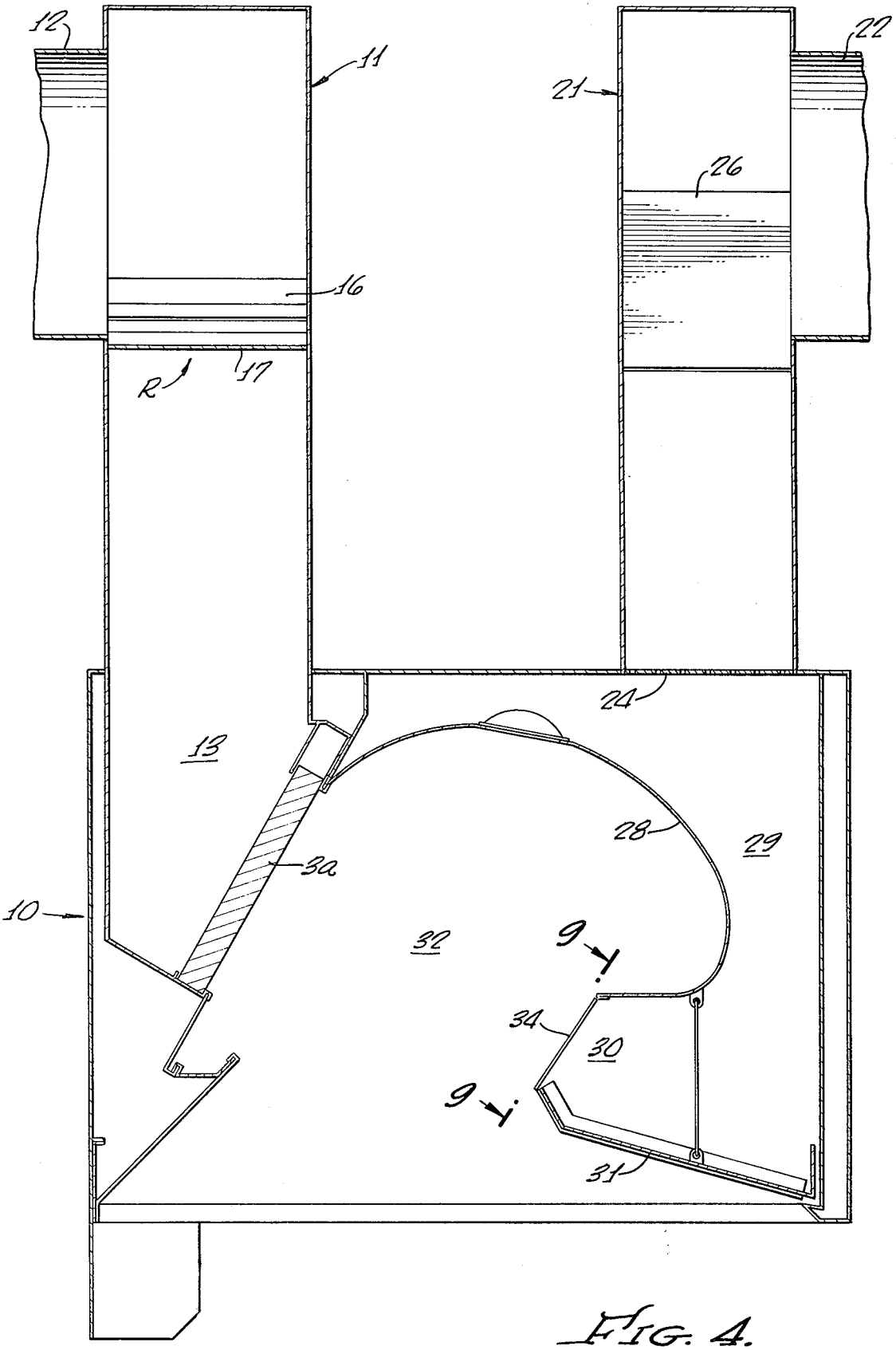
FIG. 4 is an enlarged transverse central sectional view on line 4—4 of FIG. 1 a showing of the precipitator "P" being omitted.

The restrictor or baffle means R of FIGS. 2 and 4 is illustrated to comprise three small elongated baffles or deflectors 16–18 which extend horizontally between the front and rear walls of exhaust plenum extension 11. Such baffles 16–18 are disposed generally beneath (and adjacent) the outlet duct 12. They are so shaped and located, empirically, that the flow of air and fumes through the grease filters 3*a* will be substantially uniform across the entire width of the apparatus. The central one 17 of baffles may be provided with large, unpluggable (by grease) ports or slots for self-draining purposes.

Numerous sizes and shapes of restrictor means R may be employed, the exact sizes and shapes being empirically determined. In place of the illustrated baffles or deflectors, the front wall (for example) of plenum extension 11 may be contoured, or else indented or dimpled as described below, to provide a constriction below the duct 12, this being a different form of restrictor or baffle means R.

Because of the large diameter of duct 12, in relation to the thickness or depth of the exhaust plenum extension, air and fumes tend (as noted above) to enter such duct from all portions of extension 11 and thus from the full width of the apparatus. However, because duct 12 is much closer to those filters 3*a* at the central region of the apparatus, there would (in the absence of restrictor or baffle means R) tend to be more flow through the central filters (those directly below duct 12) than through those near the "sides" of the apparatus (the left and right regions shown in FIG. 2). The restrictor or baffle means R corrects this tendency and makes the flow velocity substantially uniform as stated above, despite the fact that plenum extension 11 is not as tall as would be expected for a very "wide" hood.

The apparatus also includes an inlet plenum 21 which connects through a duct 22 to supply blower 23. The diameter of the cylindrical duct 22 is much larger than the thickness or depth of plenum 21. Supply air therefore spreads or "splashes" to the upper regions of plenum 21, and flows down through a horizontal diffuser plate 24 such as is shown at 41, FIG. 3, of the cited U.S. Pat. No. 3,664,255.

The illustrated unitary and relatively symmetrical smoke-hood apparatus is such that supply blower 23 is disposed on one side of supply or inlet plenum 21, whereas exhaust blower 14 is disposed on the remote side of exhaust plenum extension 11. Members 11 and 21 therefore act as baffles, minimizing recirculation of air and fumes through the smoke-hood. Furthermore, as shown in FIG. 1, the openings of the blowers 14 and 23 are caused to face in opposite directions.

However, as indicated in the cited U.S. Pat. No. 3,664,255, at least some recirculation of fume-laden air may be tolerated. This is because the intake air does not enter the kitchen, being instead substantially confined to the hood. When and if such recirculation is desired, a single large blower may be used for both supply and exhaust purposes. A certain proportion of the recirculating air is then preferably vented to the atmosphere. Such single blower (or two blowers) may be located between (or in) one or both of the supply plenum and the exhaust plenum extension.

It is a major feature of the present invention that the grease filters operate very efficiently, particularly since flow therethrough is substantially uniform across the entire width of the apparatus. All of the filters preferably have the same, optimum settings. Such filters therefore remove much grease from the fumes.

Smoke, and additional grease, may be removed by an electrostatic precipitator such as schematically shown at P in FIG. 2. A high voltage is supplied to precipitator P from source V.

Proceeding next to a description of the baffle or constrictor means in inlet or supply plenum 21, these are located very differently than are the restrictor means R described above relative to the exhaust plenum extension.

It would be thought that the baffle or restrictor means in the supply plenum should be located primarily below the supply conduit to such plenum, in that the shortest distance to the supply throat of the apparatus, from the supply conduit, is along a vertical line. Surprisingly, however, this manner of location has been found to be not desired. Instead, the baffle or constriction means in the supply plenum is primarily between the inlet duct 22 and the two "sides" of the apparatus.

Figure 3:
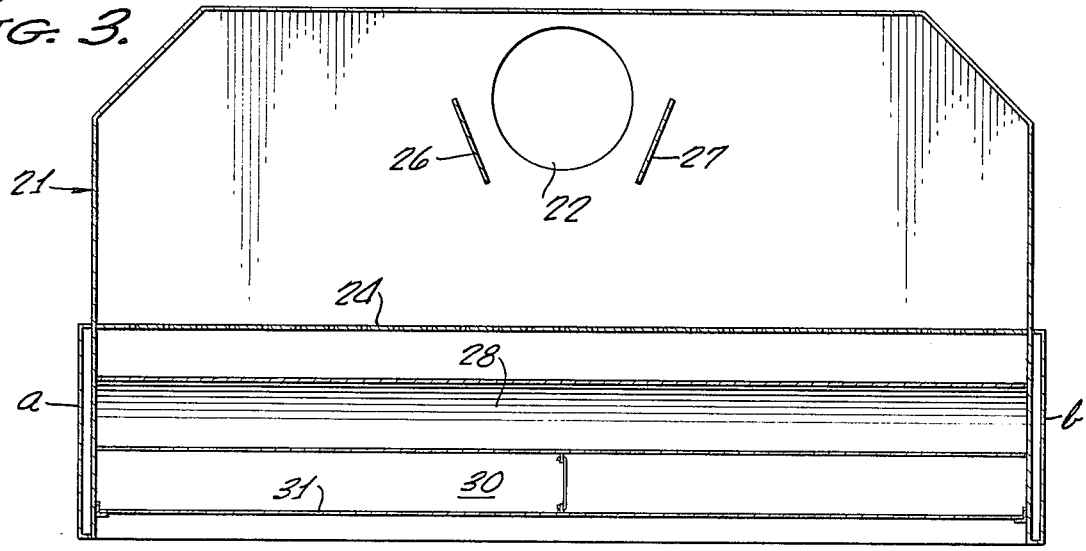
FIG. 3 is a vertical section on line 3—3 of FIG. 1, showing the supply plenum and the associated baffles (or constrictors) and duct.

Referring to FIGS. 3 and 4, two corresponding baffle or constriction plates 26 and 27 are illustrated. They are preferably somewhat inclined as shown in FIG. 3, and are spaced short distances from opposite sides of the lower portion of inlet or supply duct 22. The plates 26–27 extend clear across the supply plenum 21, but such full extension is not always necessary as described below relative to subsequent embodiments. (The absence of full extension across the plenum also applies relative to the exhaust side of the apparatus, as described below relative to subsequent embodiments of the baffle or constriction means in the exhaust plenum extension).

Again referring to FIG. 3, the plates 26–27 have lower portions disposed somewhat beneath the sides of supply or inlet duct 22, and have upper portions which are located on about the same level as the horizontal diametrical plane containing the axis of such duct 22. Primarily, the plates 26 and 27 are disposed relatively between the supply duct and the lower regions of the "sides" of the apparatus (that is to say the lower regions of the portions of inlet plenum 21 which are adjacent the surfaces a and b indicated above relative to FIG. 1). It is pointed out that there is no plate or constrictor below a large central region of the supply duct 22.

Plates 26–27 thus tend to reduce the flow of air from supply duct 22 to the "sides" of inlet plenum 21, and are empirically shaped, sized and located to create a substantially uniform flow of supply air throughout the entire width of the apparatus. The plates 26–27 cooperate with the diffuser plate 24 described above. Such diffuser plate 24 has the primary purpose of preventing erratic air flow, and thus augmenting the uniformity of flow of the inlet air. Plate 24 operates as a "pressure plate".

Referring next to FIG. 4, which shows schematically the interior of the grease hood 10, this is (except as specifically described below) identical to what is described in the cited copending patent application Ser. No. 497,690. Thus, there is a curved vortex liner 28 which defines, between it and the front wall of the housing, a vertical throat 29 receiving supply air from inlet plenum 21. The vertical throat 29 communicates with a horizontal throat 30, the latter being defined between a plate 31 and an inward extension of vortex liner 28.

Supply air from the horizontal throat 30 discharges therefrom into a capture, entrainment, and vortex chamber 32, and is directed against the filter means 3*a*. The chamber 32 also receives fumes from the cooking appliance (or appliances) disposed beneath the hood 10, so that the combined air and fumes either pass directly through the filter means 3*a* or first vortex upwardly and downwardly as described in the cited application No. 497,690.

The filters are given the reference characters "3*a*" to accord with the reference numeral "3" in the cited U.S. Pat. No. 3,566,585, which shows the type of impingement-centrifugal grease filter presently employed by applicant. As shown in FIG. 2, there is usually a horizontal row of such filters 3*a*, each being mounted in a manner facilitating removal for cleaning purposes.

As above indicated, the velocity of flow of air and fumes through the filters 3*a* depends, assuming that in each filter is identical to each other filter, upon the velocity of flow of air and fumes passing toward the upstream surfaces of such filters (from horizontal throat 30), and upon the suction effect created by the exhaust blower 14. The above-described apparatus R, 26–27, 24, etc., create conditions such that the flow through the filter means 3*a* is substantially uniform across the entire width of the apparatus, due to the substantially uniformity of supply conditions on the upstream side of each individual filter 3*a*, and of exhaust conditions on the downward stream thereof.

Such substantial uniformity of flow creates optimum effectiveness of the filtering action, results in a passing of a minimum of grease through the filters to the exhaust plenum 11, and creates other desired effects.

BAFFLE MEANS AT THE SIDES OF SUPPLY THROAT 30

To prevent excessive flow velocities of supply air out of supply throat 30 at the "sides" of the apparatus, there are provided small plates 34 and 35 as shown in FIGS. 4 and 9. Each such plate is shown as extending between the lip of plate 31 and the corresponding lip (of vortex liner 28) disposed thereabove. As an example, each such plate 34–35 may be about five inches in width (left-to-right direction as viewed in FIG. 9). The plates 34–35 block inlet flow at the extreme "sides" of the apparatus, so that the air backs up and then discharges at regions between such plates. By the time the filters 3*a* are reached by the air curtain emanating from the portion of throat 30 between plates 34 and 35, such curtain has fanned-out sufficiently that the extreme ends of the row of filters 3*a* receive the desired amount of supply air at the desired velocity.

The use of the side plates 34–35 has been found to be highly desirable in much less wide hoods than those specifically mentioned above. For example, the plates 34–35 may be employed in hoods five to ten feet in width, and which do not incorporate any baffle or constriction means R or 26–27. This is not to imply, however, that the elements 34–35 should not be employed in the very wide hoods of the type indicated above.

ADDITIONAL EMBODIMENTS OF THE BAFFLE OR CONSTRICTION (RESTRICTOR) MEANS

As indicated above, the exact size, precise location, etc., of each baffle or constriction means is empirically determined. To facilitate such empirical determination, to permit one type of baffle to be employed on hoods of different widths, etc., the baffle or constrictor means may be adjustably mounted.

FIG. 5 shows baffle adjustment in an inward or outward direction. The baffle when in an outwardly-adjusted position does not extend the full distance across the inlet plenum 21. A shoe or slide element 36 is fixedly mounted on one vertical wall of the inlet plenum 21, having a slot therethrough which corresponds closely to a slot in such vertical wall. Thus, each of the baffle or constriction means 26*a* (or one corresponding to 27, and not shown) employed relative to the supply plenum 21 may be adjusted inwardly or outwardly (horizontally) a desired distance. Suitable set-screw or other means may be employed to maintain the baffle in a adjusted relationship. Elements 26*a*, and the one corresponding to 27, are located as shown in FIG. 3 relative to elements 26–27.

The illustrated slide or shoe 36 has sufficient width and strength to maintain the associated baffle 26*a*, etc., properly supported.

It is within the scope of the invention to employ two baffles 26, or two baffles 27, each extending inwardly from opposite sides of the supply plenum 21. Preferably, such two baffles 26, or two baffles 27, extend inwardly directly toward each other and are capable of meeting in the central plane of the supply plenum. Alternatively, however, there may be some staggering or offsetting of these elements. There may be also some offsetting of the baffle elements on opposite sides of the inlet plenum.

EMBODIMENT OF FIGS. 6 and 7

Referring next to FIG. 6, there is shown a fixed relationship which is adapted to be employed when the construction of the inlet plenum is standardized, for a particular size of apparatus. This is simple and economical construction, and one which is particularly adapted to prevent grease accumulation. It comprises the use of two indented or dimpled portions 38–39. The portions 38–39 are formed in the opposed vertical walls of supply plenum 21. They are located correspondingly, as shown in FIG. 7, to the locations of the above-described plates 26 and 27, FIG. 3.

The indented or dimpled portions 38 and 39 may be much larger in area of depth, may be employed in greater numbers than are here illustrated, and/or may only be employed relative to only one of the vertical walls of the inlet plenum 21.

EMBODIMENT OF FIG. 8

It is emphasized that the use of adjustable baffles, or of dimples or indentations in the plenum walls, etc., may be employed on the exhaust side of the apparatus. Thus, for example, the elements 16–18 of FIGS. 2 and 4 may be mounted for inward or outward adjustment.

In the embodiment of FIG. 8, there are specifically illustrated a plurality of indentations or dimples 41 and 42 which extend inwardly from opposite side walls of the exhaust plenum 11. The dimples 41 correspond in location to element 18 (FIG. 2), whereas the dimples 42 correspond in location to element 17 in FIG. 2.

It is to be understood that a third set of dimples is provided and corresponds in location to that of element 16 in FIG. 2.

Figure 10:
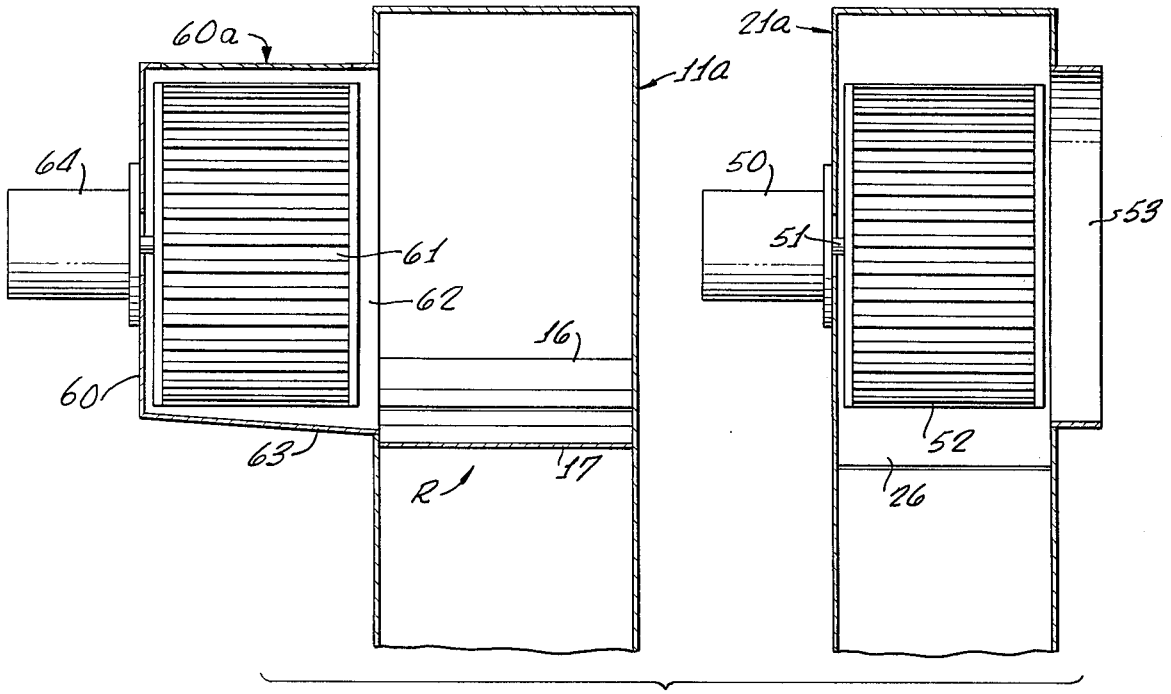
FIG. 10 is a central sectional view corresponding to only the upper portion of FIG. 4, and showing a form of apparatus wherein the impeller of the supply blower is incorporated in the supply plenum, and a part of the housing of the exhaust blower is built onto the exhaust plenum, with consequent major advantages relative to compactness, economy of production, ease of installation, etc.
Figure 11:
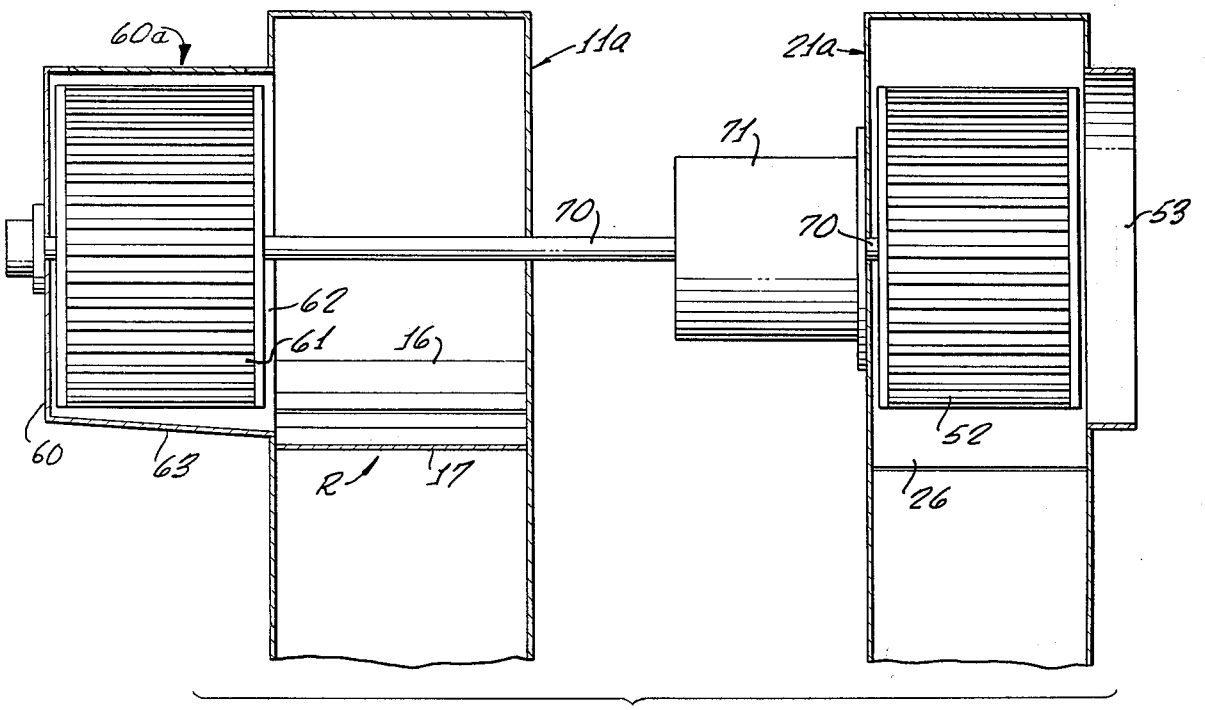
FIG. 11 is a view corresponding to FIG. 10 but showing an embodiment in which only a single motor is employed for the impellers of both the supply blower and the exhaust blower.

EMBODIMENTS OF FIGS. 10 and 11

Referring first to FIG. 10, it is to be understood that all of the components are identical to those shown in FIG. 4 (and other views) except as is specifically stated relative to the blower means.

There is mounted on one vertical wall of supply plenum 21*a*, preferably the vertical wall relatively adjacent the exhaust plenum, an electric motor 50 having a horizontal axis which is substantially perpendicular to the plenum. Motor 50 has a horizontal shaft 51 mounted in suitable bearings, and which drives an impeller 52 disposed centrally within the supply plenum 21*a*. The impeller 52 is of such type of construction (preferably having backwardly-inclined blades) that rotation of the shaft 51 causes air to be centrifugally thrown outwardly in all directions from the impeller. Thus, air is drawn from the ambient atmosphere into the central portions of the impeller, through an inlet opening schematically represented at 53 and which is formed in the remaining vertical wall of the inlet plenum 21*a* (preferably the wall remote from the exhaust plenum 11*a*). The inlet opening 53 may take the form of a short cylindrical sleeve which opens into the supply plenum 21*a* and is coaxial with the shaft 51.

Referring next to the exhaust side of the apparatus of FIG. 10, a housing 60 is built onto the exhaust plenum 11*a*, preferably on the side thereof remote from the supply plenum 21*a*. Housing 60 has mounted therein an impeller 61 adapted when rotated to throw fumes centrifugally outwardly through a suitable exhaust or discharge opening 60*a* to the ambient atmosphere. Such fumes enter housing 60 via opening 62 to the exhaust plenum. The bottom wall or portion 63 of the housing 60 for impeller 61 is inclined downwardly toward the exhaust plenum 11*a*, thus permitting drainage of grease from housing 60 into such exhaust plenum. A motor 64 is mounted on housing 60 coaxially of impeller 61, and drives the same at the desired speed. Air and fumes are thus exhausted from plenum 11*a* through the opening 60*a* in housing 60.

Proceeding next to a description of FIG. 11, the construction is substantially identical to that of FIG. 10 except that one of the motors, preferably motor 64, is omitted and a single and larger motor (motor 71) is employed to drive both of the impellers 52 and 61. This is effected by connecting the motor 50 through a horizontal shaft 70 to impeller 61, such shaft extending through suitable mounting and bearing means (not shown) in that wall of exhaust plenum 11*a* which is closest to the supply plenum. The motor 64 is omitted.

Suitable gearing, not shown, may be interposed between the single motor and at least one of its associated impellers, in order to cause the supply impeller 52 to rotate at desired speed and the exhaust impeller 61 to rotate at desired speed. Furthermore, the two impellers 61 and 52 may be sized or designed differently, so that even when rotating at the same speed they pass different amounts of air therethrough. In this connection it is pointed out the amount of air passed through the supply plenum 21*a* is normally smaller than that passed out the exhaust plenum 11*a*, due to the effects of convection upwardly from the cooking appliance into the hood.

The foregoing detailed description is to be clearly understood as given by way of illustration and example only, the spirit and scope of this invention being limited solely by the appended claims.

I claim:

1. Smoke-hood apparatus for exhausting fumes from a space above a cooking appliance in a room in a restaurant, which apparatus incorporates economical, compact and effective supply and exhaust blower means, said smoke-hood apparatus comprising:

(a) a smoke-hood having grease filter means therein, said grease filter means being adapted to be mounted above a cooking appliance in a room in a restaurant, and adapted to remove grease from the air and fumes passed through said filter means, (b) means to effect flow of air across a space above said cooking appliance and toward said filter means, said air containing fumes from said cooking appliance, (c) exhaust and supply blower means to exhaust air and fumes to the exterior of said room, and to effect forced supply of at least air to said hood without depleting said room of major amounts of air, (d) means to conduct air and fumes from said filter means to at least part of said exhaust blower means, said last-named means comprising means to define an exhaust plenum chamber located on the opposite side of said filter means from said cooking appliance, one major wall portion of said exhaust plenum chamber being formed by said grease filter means, said last-named means further comprising means to define extended exhaust plenum chamber means which greatly extends said exhaust plenum chamber, and (e) means to effect conduction of air from said supply blower means to said hood, said last-named means comprising means to define a supply plenum chamber and further comprising means which greatly extends said supply plenum chamber in a direction away from the smokehood apparatus, characterized in that said supply blower means includes at least one impeller disposed in said extended supply plenum chamber at a location spaced from said hood, said impeller being substantially unenclosed in said extended supply plenum chamber and having a size much smaller than that of said extended supply plenum chamber.

2. The invention as claimed in claim 1, in which an exhaust impeller housing is mounted on said means to define said extended exhaust plenum chamber and communicating therewith, in which said exhaust blower means comprises an impeller rotatably mounted in said impeller housing, in which means are provided to drain grease from said exhaust impeller housing into said extended exhaust plenum, and in which an exhaust port is provided in said exhaust impeller housing to discharge air and fumes therefrom.

3. The invention as claimed in claim 1, in which said impeller has a substantially horizontal axis which is generally perpendicular to the forward wall of said means to define said extended supply plenum chamber.

4. The invention as claimed in claim 1, in which an intake opening is provided in said extended supply plenum defining means adjacent said impeller.

5. The invention as claimed in claim 4, in which an impeller housing is mounted on said extended exhaust plenum defining means and communicates therewith, in which a second impeller is rotatably mounted in said impeller housing, and in which said impeller housing communicates with the ambient atmosphere whereby rotation of said impeller effects discharge of air and fumes from said extended exhaust plenum chamber to the atmosphere.

6. The invention as claimed in claim 5, in which a single motor is connected to drive both of said impellers.

7. The invention as claimed in claim 5, in which said one impeller and said second impeller are connected together and are driven by a single motor.

8. The invention as claimed in claim 7, in which said one impeller and said second impeller are coaxial with each other and are connected by a horizontal shaft driven by said single motor.

9. Smoke-hood apparatus for exhausting fumes from a space above a cooking appliance in a room in a restaurant, which apparatus incorporates economical, compact and effective supply and exhaust blower means, said smoke-hood apparatus comprising:

(a) a smoke-hood having grease filter means therein, said grease filter means being adapted to be mounted above a cooking appliance in a room in a restaurant, and adapted to remove grease from the air and fumes passed through said filter means, (b) means to effect flow of air across a space above said cooking appliance and toward said filter means, said air containing fumes from said cooking appliance, (c) exhaust and supply blower means to exhaust air and fumes to the exterior of said room, and to effect forced supply of at least air to said hood without depleting said room of major amounts of air, (d) means to conduct air and fumes from said filter means to at least part of said exhaust blower means, said last-named means comprising means to define an exhaust plenum chamber located on the opposite side of said filter means from said cooking appliance, one major wall portion of said exhaust plenum chamber being formed by said grease filter means, said last-named means further comprising means to define extended exhaust plenum chamber means which greatly extends said exhaust plenum chamber, and (e) means to effect conduction of air from said supply blower means to said hood, said last-named means comprising means to define a supply plenum chamber and further comprising means which greatly extends said supply plenum chamber in a direction away from the smoke hood apparatus, characterized in that said exhaust blower means includes an exhaust impeller housing mounted on said means to define said extended exhaust plenum chamber means and communicating with the extended exhaust plenum chamber, and further comprises an impeller rotatably mounted in said impeller housing, and in which means are provided to drain grease from said exhaust impeller housing into said extended exhaust plenum chamber, there being an exhaust port provided in said exhaust impeller housing to discharge air and fumes therefrom.

* * * * *